United States Patent [19]

Anderson

[11] 4,343,450

[45] Aug. 10, 1982

[54] PLATE HOLDER

[75] Inventor: George C. Anderson, Mount Prospect, Ill.

[73] Assignee: Altra Corporation, Elk Grove Village, Ill.

[21] Appl. No.: 102,239

[22] Filed: Dec. 10, 1979

[51] Int. Cl.[3] ..... A47G 1/24

[52] U.S. Cl. ..... 248/454; 248/460

[58] Field of Search ..... 248/454, 455, 456, 460; 211/43, 184

[56] References Cited

U.S. PATENT DOCUMENTS

| | | | |
|---|---|---|---|
| 1,208,622 | 12/1916 | Muller | 248/461 |
| 1,363,138 | 12/1920 | Markham | 211/43 |
| 1,875,288 | 8/1932 | Welk et al. | 211/43 |
| 2,419,721 | 4/1947 | Kopp | 248/456 |
| 3,487,945 | 1/1970 | Barham | 211/184 X |
| 3,999,734 | 12/1976 | Gibson | 248/460 |
| 4,162,013 | 7/1979 | Tucker | 211/184 X |

*Primary Examiner*—William H. Schultz

*Attorney, Agent, or Firm*—Anthony S. Zummer

[57] ABSTRACT

The subject invention relates to a plate holder for holding a plate, and more particularly, an ornamental plate, in a substantially vertical attitude for displaying the plate. The plate holder includes a base having a track with a plurality of serrations on the track. A support is movably mounted on the track. The support includes a plate panel which is adapted for being substantially perpendicular to the base. The plate panel has a tooth formed integral therewith for engaging the serrations on the track for releasably locking the support to the base in a selected position.

5 Claims, 4 Drawing Figures

PLATE HOLDER

BACKGROUND OF THE INVENTION

Collectors of plates and other like objects find it to be desirable to display the plates in what is a substantially vertical attitude so that ornamentation and design of a plate may be viewed on a substantially horizontal sightline. In order to hold a plate in a substantially vertical attitude, it is necessary to hold the rim of the plate at a lower position and then provide support to a base of the plate toward the middle or above the middle of the plate. In certain instances, special cupboards are built wherein a shelf of the cupboard contains a groove adjacent to a wall of the cupboard so that a plate rim may be placed in the groove and the base of the plate is positioned against the wall to hold the plate substantially vertical. In certain instances, it is desirable to provide a plate holder which is portable so that the plate holder is an integral unit which supports the plate and may be positioned on a shelf which does not have a groove, or the plate holder is free standing on a sideboard or buffet. Devices of this general type are well-known and a popular type of device is a wooden plate holder. The wooden plate holders are usually large in order to have sufficient bulk to make them resistant to fractures and these plate holders are sufficiently large so that they distract from the plate. Smaller or compact plate holders may be made of metal or plastic, but these plate holders are expensive to manufacture and in certain instances difficult to handle.

SUMMARY OF INVENTION

The instant invention relates to an improved plate holder for holding a plate in a substantially vertical attitude for displaying the plate. The plate holder includes a base having a track therein with a plurality of serrations on the track. A support is movably mounted on the track. The support includes a plate panel particularly adapted for being held substantially vertical to the base and in engagement with plate to hold the plate in a substantially vertical attitude. The support also includes a tooth connected to the plate panel for releasably engaging the serrations on the track for holding the plate panel in a selected position. The base and the support are both made of a clear styrene and may be easily manufactured at a minimal cost.

DESCRIPTION OF THE PREFERRED EMBODIMENT

Figure 1:
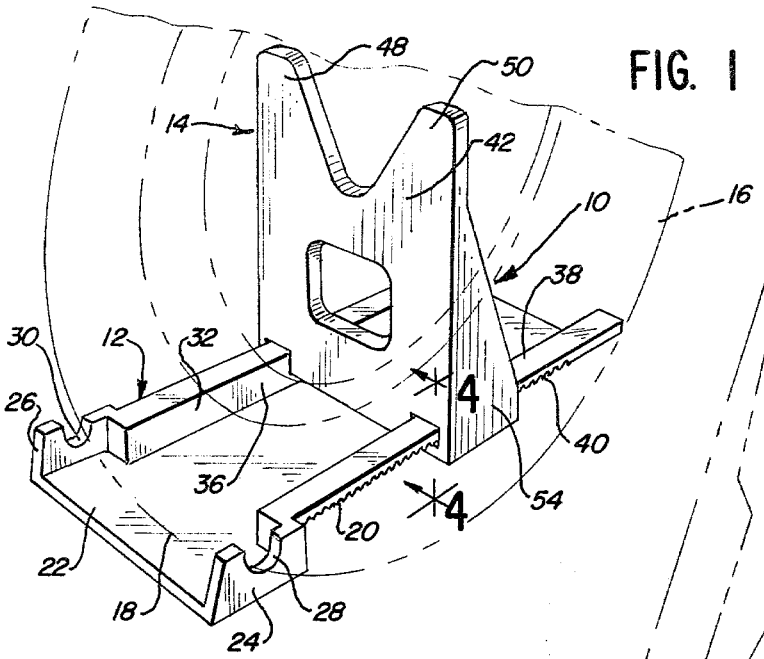
FIG. 1 is a perspective view of a plate holder embodying the present invention with a plate mounted thereon shown in phantom view.

Referring now to the drawing, and especially to FIG. 1, a plate holder, generally indicated by numeral 10, is a specific embodiment of the instant invention. Plate holder 10 generally consists of a molded plastic base 12 and a molded plastic support 14 lockably engaging the base for holding a conventional plate 16 shown in phantom view.

Figure 3:
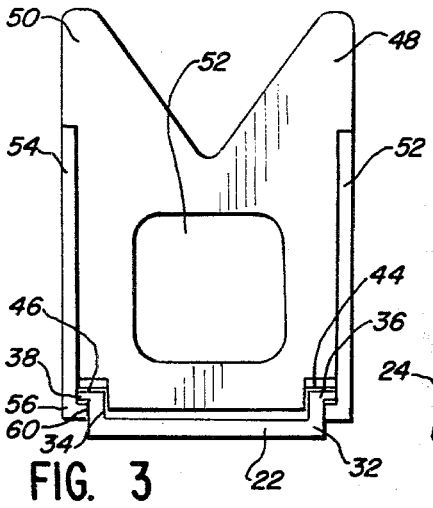
FIG. 3 is an end view of the plate holder of FIG. 1.
Figure 4:
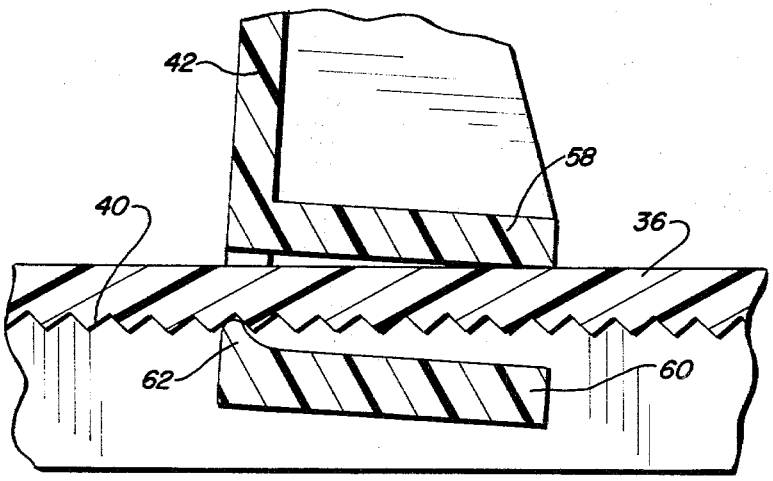
FIG. 4 is an enlarged cross-sectional view taken on line 4—4 of FIG. 1 showing a portion of the support including a tooth in locking engagement with a serration on a track.

Base 12 generally consists of a foundation 18 and a track 20. The foundation 18 includes a floor 22 with a pair of arms 24 and 26 formed integral with floor 22. The arms 24 and 26 include plate groove 28 and 30, respectively to form a rim catch for holding a plate rim. Track 20 includes a pair of parallel track walls 32 and 34 formed integral with floor 22. Track walls 32 and 34 are perpendicular to floor 22. Track ears 36 and 38 which are parallel to each other are formed integral with walls 32 and 34, respectively. Ears 36 and 38 are perpendicular to their respective walls and extend away from each other as is seen in FIG. 3. Each of the ears 36 and 38 has a plurality of identical serrations 40 on the underside thereof, that is, the side adjacent to floor 22.

Support 14 is slidably mounted on track 20. The support includes a plate panel 42 which as a pair of L-shaped apertures 44 and 46 adjacent to and opening into the outer edge thereof. The grooves slidably receive track 20. The plate panel includes a pair of upstanding ears 48 and 50 on the upper edge thereof which ears are particularly adapted to engage plate 16. The center of the panel includes an aperture 52. A pair of parallel bracket walls 52 and 54 is formed integral with opposed edges of the plate panel and are perpendicular to the plate panel. The support includes a pair of identical track locks 56 adjacent to receptive L-shaped apertures. Each lock 56 includes an upper wall 58 which is formed integral with its respective bracket wall and is perpendicular to plate panel 42 and its respective bracket wall. A lower wall 60 is also formed integral with and perpendicular to each respective bracket wall and is parallel to its respective upper wall 58. A tooth 62 is formed integral with each lower wall 60 adjacent to the plate panel. The distance between the upper portion of tooth 62 and the closest surface of its receptive upper wall 58 is slightly greater than the height of its respective track ear and the serrations 40 so that support 14 may slide on ears 36 and 38 when the plate panel is perpendicular to floor 22.

In order to use the instant plate holder, the support is positiioned on the track ears an appropriate distance from plate grooves 28 and 30. Plate 16 then has its rim positioned in grooves 28 and 30 and the plate is allowed to tilt back until the plate engages ears 48 and 50 of the plate panel. The weight of the plate then tends to rotate the support so that each tooth 62 engages its respective serrations 40 on its respective ear. Accordingly, the plate is held in position.

Figure 2:
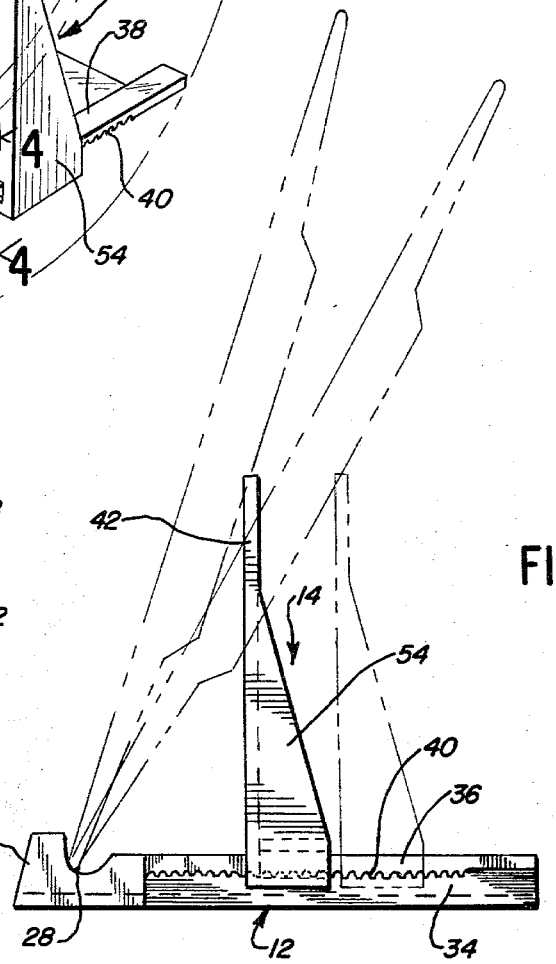
FIG. 2 is a side elevational view of the plate holder of FIG. 1 with a plate shown in phantom view supported by the plate holder and with a support of the plate holder being shown in a secon position in phantom view.

Looking now to FIG. 2, it may be seen how the attitude of the plate may be adjusted. Assuming that the plate is positioned against support 40 shown in solid form, it may be appreciated that it is held in position by the interaction of each tooth 62 with its respective serrations 40. To move the plate from the more vertical attitude shown to an attitude having an angle closer to the horizontal, the support may be moved away from arms 24 and 26. In order to move the support back, it is only necessary to tilt the support forward until upper wall 58 is substantially parallel to respective ears 36 and 38. Then it is possible to slide the support along the ears away from arms 24 and 28. When it is desired to lock the support again, the support is pivoted until each tooth 62 is locked into position. The plate is placed on the support to hold the support into its locked position.

The base is manufactured from a single piece of injection molded clear styrene as is the support. As was described above, the support may be quickly and easily placed onto the base simply by sliding the support onto the ears 36 and 38. Inasmuch as plate holder is made of clear styrene, that portion of the plate holder which is visible does not distract from the plate so that the plate mounted on the support plate holder provides an attractive appearance.

Although a specific embodiment of the herein disclosed invention has been shown and described in detail above, it is readily apparent that those skilled in the art may make various modifications and changes without departing from the spirit and scope of the present invention. It is to be expressly understood that the instant invention is limited only by appended claims.

What is claimed is:

1. A plate holder for holding a plate in a substantially vertical attitude for displaying the plate comprising; a base, said base having a rim catch for holding a rim of the plate, said base having a track connected to the rim catch with a plurality of serrations on the track; and a support movably mounted on the base and being substantially perpendicular to the base, said support having a plate panel adapted for engaging the plate having its rim in the rim catch to hold the plate in a substantially vertical attitude, and a tooth connected to said plate panel and engageable with the serrations of the track for releasably holding the support in a selected position relative to the base for holding the plate in a selected attitude, the track including an elongated ear, said ear having the serrations on its lower side, the support including an upper wall slidably engaging the ear on its upper surface, the tooth fixedly connected to the upper wall and being spaced from the upper wall sufficiently to allow the upper wall to slide on the upper surface of the ear when the upper wall is substantially parallel to the ear and the tooth to engage lockably the serrations when the upper wall is not parallel to the upper surface of the ear.

2. A plate holder for holding a plate in a substantially vertical attitude for displaying the plate comprising; a base, said base having a rim catch for holding a rim of the plate, said base having a track connected to the rim catch with a plurality of serrations on the track; and a support movably mounted on the base and being substantially perpendicular to the base, said support having a plate panel adapted for engaging the plate having its rim in the rim catch to hold the plate in a substantially vertical attitude, and a tooth connected to said plate panel and engageable with the serrations of the track for releasably holding the support in a selected position relative to the base for holding the plate in a selected attitude, the plate including a pair of spaced upstanding panel ears for engagement with the plate; the track including an elongated ear, said ear having the serrations on its lower side, the support including an upper wall slidably engaging the upper side of the ear, and the tooth fixedly connected to the upper wall and being spaced from the upper wall a distance sufficient to allow the upper wall to slide on the upper side of the ear when the upper wall is substantially parallel to the ear and the tooth to engage lockably the serrations when the upper wall is not parallel to the upper surface of the ear.

3. A plate holder for holding a plate in a substantially vertical attitude for displaying the plate comprising: a base, said base having a rim catch for holding a rim of the plate, said base having a track connected to the rim catch with a plurality of serrations on the track; and a support movably mounted on the base and being substantially perpendicular to the base, said support having a plate panel adapted for engaging the plate having its rim in the rim catch to hold the plate in a substantially vertical attitude, and a tooth connected to said plate panel and engageable with the serrations of the track for releasably holding the support in a selected position relative to the base for holding the plate in a selected attitude, said plate panel having a pair of apertures for slidably receiving the track of the base, said track including a pair of parallel elongated ears positioned in respective apertures of the plate panel, each ear having serrations on its lower side, the support including a pair of parallel upper walls slidably engaging respective ears on their respective upper surfaces, the tooth fixedly connected to one of the upper walls, a second tooth fixedly connected to the other upper wall, said teeth being spaced from the respective upper walls a sufficient distance to allow each upper wall to slide on the upper surface on the respective ear when the upper wall is substantially parallel to the respective ear and each tooth to engage lockably the serrations on its respective ear when the respective upper wall is not parallel to the upper surface of the respective ear.

4. A plate holder for holding a plate in a substantially vertical attitude for displaying the plate comprising: a base, said base having a rim catch for holding a rim of the plate, said base having a track connected to the rim catch with a plurality of serrations on the track; and a support movably mounted on the base and being substantially perpendicular to the base, said support having a plate panel adapted for engaging the plate having its rim in the rim catch to hold the plate in a substantially vertical attitude, and a tooth connected to said plate panel and engageable with the serrations of the track for releasably holding the support in a selected position relative to the base for holding the plate in a selected attitude, said plate panel having a pair of apertures adjacent to its lower edge for slidably receiving the track of the base and a pair of spaced upstanding panel ears for engagement with the plate, said track including a pair of elongated track ears positioned in respective apertures in the plate panel, each of said track ears having serrations on its lower side, the support including a pair of integral parallel upper walls slidably engaging a respective track ear on its upper surface, said tooth formed integral with one of the upper walls, a second tooth formed integral with the other of the upper walls, each of said teeth being spaced away from its respective upper wall sufficient to allow the upper wall to slide on the upper surface of its respective track ear when the upper wall is substantially parallel to the respective track each and each tooth to engage lockably the respective serrations when the respective upper wall is not parallel to the upper surface of the respective track ear, said base being molded of a clear styrene, and said support being molded of a clear styrene.

5. A plate holder for holding a plate in a substantially vertical attitude for displaying the plate comprising: a substantially flat floor, a pair of arms formed integral with the floor and spaced from each other, a plate groove formed in each of the arms and being particularly adapted for engaging a rim of a plate held in the plate holder, a pair of parallel elongated walls formed integral with the floor, an elongated track ear formed integral with each of the walls and being parallel to each other, a plurality of serrations formed in each of the track ears on the side adjacent to the floor, a plate panel slidably mounted on the track ears, said panel having a pair of grooves each slidably receiving a respective wall and integral track ear, said plate panel having a pair of spaced panel ears engageable with a base of the plate held in the plate holder, a pair of parallel bracket walls formed integral with the plate panel and perpendicular to the plate panel, an upper wall formed integral with each of the bracket walls and being slidably engageable with each of the track ears, a lower wall formed integral with each of the bracket walls and being parallel to the upper wall, the distance between each upper wall and its respective lower wall being slightly greater than the thickness of the respective track ear including the maximum height of the serrations, and a tooth formed integral with each lower wall and being engageable with its respective serrations when the plate panel is titled away from the arms having the plate groove for holding the plate panel in a selected attitude to hold the plate in a substantially vertical attitude.

* * * * *

UNITED STATES PATENT OFFICE

CERTIFICATE OF CORRECTION

PATENT NO. : 4,343,450

DATED : August 10, 1982

INVENTOR(S) : George C. Anderson

It is certified that error appears in the above-identified patent and that said Letters Patent are hereby corrected as shown below:

Col. 2, line 9, "groove" should be -- grooves --.

line 47, "positiioned" should be -- positioned --.

Signed and Sealed this

Fifth Day of October 1982

[SEAL]

*Attest:*

GERALD J. MOSSINGHOFF

*Attesting Officer*

*Commissioner of Patents and Trademarks*